US005787808A

United States Patent [19]

Stram et al.

[11] Patent Number: 5,787,808

[45] Date of Patent: Aug. 4, 1998

[54] HOLLOW CYLINDER RETENTION DEVICE

[75] Inventors: James K. Stram, Wakefield, R.I.; Jan C. R. Lindstrom, Lancaster, Pa.; Klaus Graf, Augsburg, Germany

[73] Assignee: Man Roland Druckmaschinen, Augsburg, Germany

[21] Appl. No.: 782,168

[22] Filed: Jan. 14, 1997

[51] Int. Cl.[6] ..... B41F 5/00

[52] U.S. Cl. ..... 101/216; 101/153; 101/375; 101/174

[58] Field of Search ..... 101/212, 216, 101/217, 174, 177, 153, 152, 132, 479, 375; 403/31, 372; 492/4, 45, 47

[56] References Cited

U.S. PATENT DOCUMENTS

| | | | |
|---|---|---|---|
| 2,093,281 | 9/1937 | Krueser | 192/85 |
| 2,251,444 | 8/1941 | Fawick | 192/88 |
| 3,547,244 | 12/1970 | Fergle | 192/74 |
| 3,598,050 | 8/1971 | Thompson | 101/216 |
| 3,804,221 | 4/1974 | Valantin | 192/88 |
| 3,861,815 | 1/1975 | Landaeus | 403/370 |
| 4,044,678 | 8/1977 | Rasmussen | 101/153 |
| 4,093,052 | 6/1978 | Falk | 192/88 |
| 4,220,082 | 9/1980 | Fischer | 101/216 |
| 5,186,103 | 2/1993 | Gelinas et al. | 101/181 |
| 5,351,616 | 10/1994 | Gelinas et al. | 101/218 |
| 5,537,923 | 7/1996 | Boor et al. | 101/375 |

*Primary Examiner*—Christopher A. Bennett
*Attorney, Agent, or Firm*—Graham & James LLP

[57] ABSTRACT

A hollow cylinder retention device includes a hollow cylinder and a pair of bearers disposed at opposite ends of the hollow cylinder. Mounted on each of the bearers is a bushing including an actuator for applying a clamping force to a clamping portion of the bearers to securely clamp the hollow cylinder onto a rotatable cylinder shaft. The bushings are arranged on the respective bearings to apply a clamping pressure at a location that is spaced from the bearer points where the hollow cylinder is mounted on the bearers to avoid damage to the bushings and bearers. The hollow cylinder, bearers and bushings are connected to form an integral unit that is easily and quickly mounted and removed from a rotatable shaft.

24 Claims, 7 Drawing Sheets

HOLLOW CYLINDER RETENTION DEVICE

BACKGROUND OF THE INVENTION

This invention relates to a cylinder retention device in a rotary web printing machine, and more particularly, to an apparatus for retaining and supporting a hollow printing cylinder in a rotary printing machine such that the printing cylinder is securely clamped to a rotatable shaft and able to be easily and quickly removed from the rotary printing machine.

DESCRIPTION OF RELATED ART

U.S. Pat. No. 5,351,616, the disclosure of which is incorporated herein by reference, describes a rotary printing machine for printing on heavy or carton-type stock webs. This type of printing often requires that the printing cylinders be exchanged. Exchanging cylinders is a difficult and time-consuming process because of the weight of the cylinders and the complicated mechanisms for clamping and supporting the cylinders in the printing machine.

FIG. 1 of the present application illustrates a cylinder retention device for a plate cylinder unit including a preferably hollow plate cylinder 113. The device shown in FIGS. 1 and 2 is similar to the device described in U.S. Pat. No. 5,351,616. The shaft 144 of the hollow plate cylinder 113 includes a tapered mounting surface 125 for mounting the bearer **103*b* of the hollow plate cylinder 113 onto the shaft 144. The bearer 103*b* includes an internal tapered surface (not shown) which is shaped for mating with the tapered surface 125 of the shaft 144. Although the tapered surface 125 is shown in FIG. 1, the internal tapered surface of the bearer 103*b* is not shown in FIG. 1. In the mounted state shown in FIG. 2, the tapered surface 125 and the internal tapered surface of the bearer 103*b*** are not visible.

The hollow plate cylinder 113 also includes a second bearer **103*c* located at an end opposite to the bearer 103*b*. Unlike the bearer 103*b* which has an internal tapered surface for mating with the tapered surface 125 of the shaft 144, the bearer 103*c*** does not include any internal tapered surface.

The plate cylinder 113 is supported on support arms 117 and 118 which are pivotably located in side plates 100 and 102 (shown in FIG. 2) and are locked by locking devices 119, 120. The shaft 144 is supported in bearings 147, 148. Connected to the shaft 144 at one outer end thereof is a gear 122 which is rotated by an intermediate drive gear 123 mounted on a shaft 121. The tapered bearer mounting surface 125 is provided to facilitate locking of the hollow plate cylinder 113 onto the shaft 144 and to provide for easy and quick removal of the hollow plate cylinder 113 from the shaft 144 without requiring that the entire plate cylinder unit be removed from the printing machine. In prior art machines, heavy and cumbersome unitary cylinders including integral shafts and solid cylinder bodies were required to be removed entirely from the printing machine so that the printing cylinders can be replaced.

As more clearly seen in FIG. 2 of the present application, removal of the plate cylinder 113 from the shaft 144 and blanket cylinder 114 from the shaft 145 is achieved by shifting the plate cylinder arm 118 and the blanket cylinder arm 130 in a direction of arrows A18 and A30 to the positions 118' and 130'. The arms 118 and 130 being located in the positions 118' and 130', respectively, are pivoted out of alignment with the opening 151 after the lock 120 on arm 118 has been released. The opening 151 then becomes free and the plate cylinder 113 and the blanket cylinder 114 can be removed. The internal tapered surface of the bearer **103*b* is expanded by hydraulic fluid applied via bores 144*b* and 145*b*, respectively, to facilitate removal of the hollow printing cylinders 113, 114 from the shafts 144, 145**.

Although the above-described structure provided several significant advantages over prior art devices, the tapered mounting surface 125 and internal matching surface in the bearer **103*b*** had some disadvantages and experienced problems.

One such disadvantage involved the amount of tools and steps involved in removing a hollow printing cylinder from and re-seating a hollow printing cylinder onto the shaft 144. When a hollow cylinder was to be removed, hydraulic pressure had to be applied via the bore **144*a* to free the tapered bearer 103*b* from the tapered bearer mounting surface 125**.

Similarly, when a new hollow plate cylinder 113 was to be mounted on the shaft 144, a hydraulic ram or jack had to be placed around the undercut portion **144*a* of the shaft 144 and hydraulic pressure was then applied at the left side of the cylinder 113, with the hydraulic apparatus clamped on the undercut 144*a*. This pressure applied to the cylinder 113 to mount the bearer 103*b* onto the tapered mounting surface 125 had to be sufficient to lock the hollow cylinder 113** in place.

However, when on impression (loading of cylinder unit against other cylinders, e.g. loading the plate cylinder 113 against the blanket cylinder 114) a large amount of force is applied to the cylinders 113 and 114. This large amount of force causes flexure and bowing in the cylinders 113 and 114, thereby applying a large amount of pressure onto the bearer points **103*b* and 103*c*. As a result, the bearer 103*c* which is not tapered experiences galling between the shaft 144 and the bearer 103*c*. Consequently, the cylinder 113 seizes to the shaft 144** and cannot be removed.

When other plate cylinder mounting and clamping arrangements were tested as an alternative to the structure shown in FIGS. 1 and 2, the results also were not satisfactory. The alternative bearers tested use hydraulic fluid clamps to hold the plate cylinder to the cylinder shaft. However, the alternative clamps experienced stress at the clamping location and cracked. As a result of the cracks, the hydraulic fluid leaked from the clamps rendering them unable to apply the required amount of pressure to hold the cylinder on the cylinder shaft.

BRIEF DESCRIPTION OF THE PRESENT INVENTION

The preferred embodiments of the present invention provide a hollow cylinder retention device which overcomes the problems of the prior art discussed above. More specifically, the preferred embodiments of the present invention provide a cylinder retention device which allows for faster and easier replacement of the cylinder requiring only a single tool. In addition, the cylinder retention device of the preferred embodiments of the present invention securely retains the cylinder on a cylinder shaft while preventing fatigue and cracking of the cylinder retention device.

According to one preferred embodiment of the present invention, a cylinder retention device is adapted for securely clamping a cylinder to a shaft whether it be a blanket cylinder, a plate cylinder or other cylinder used in a printing machine, and preferably a variable cutoff printing press. The hollow cylinder retention device is preferably mounted on a cylinder mounting shaft.

The hollow cylinder retention device according to a preferred embodiment of the present invention preferably has a hollow cylinder including a pair of bearers and a pair of bushings, the bearers and the bushings being arranged such that one of the bushings and one of the bearers are located at one end of the cylinder and the other of the bushings and the other of the bearers is located at an opposite end of the cylinder; each of the bearers includes a cylinder mounting portion having a first diameter for mounting the hollow cylinder thereon, a cylinder bearer portion adjacent the hollow cylinder mounting portion and having a second diameter larger than the first diameter for locating the hollow cylinder along the cylinder mounting portion and a clamping portion adjacent the cylinder bearer portion and having a third diameter less than the first and second diameters for receiving pressure from a respective one of the bushings to clamp the hollow cylinder to the cylinder shaft; each of the bushings being mounted on the clamping portion of a respective one of the bearers and including a pressure actuating mechanism for applying pressure from the bushing to the respective bearer to clamp the hollow cylinder onto the cylinder shaft.

The bushings preferably use hydraulic fluid or other suitable pressurized material to exert pressure on the bearer to clamp the cylinder onto the cylinder shaft. The pressurized fluid is contained in one or more sealed pockets formed in each bushing. Each of the bushings include an actuator such as an actuation screw for applying pressure to the clamping portion of the bearers by compressing the hydraulic fluid in the pockets.

The clamping portion of each of the bearers preferably has a plurality of slits or recesses formed therein so as to extend in a longitudinal direction substantially parallel to a longitudinal direction of the cylinder shaft. The slits or recesses formed in the clamping portion of the bearers define a plurality of fingers. When the actuators of the bushings are rotated to compress the hydraulic fluid, the resulting pressure is applied to the fingers of the bearers causing the fingers to deflect inwardly toward the cylinder shaft so as to securely clamp the bearers and cylinder to the shaft.

The bushings are preferably connected to the respective bearers via a socket head shoulder retaining screw which prevents the bushing from rotating relative to the bearer and the cylinder. The bearers preferably fit within bores formed in the cylinder and are preferably connected to the cylinder via cap screws.

As a result of the structure described above and in accordance with preferred embodiments of the present invention, the hollow cylinder can be quickly and easily mounted onto a cylinder shaft with a minimum of tools and effort. All that is required to mount the hollow cylinder onto the cylinder shaft is to axially slide the cylinder on the shaft until the end of the cylinder abuts the shoulder of the cylinder shaft. Then, using a single tool, such as an Allen wrench or screwdriver, rotate the actuation member(s) to compress the fluid in the bushings thereby causing the fingers of the bearers to be forced inwardly toward the shaft so as to clamp the cylinder to the shaft.

When a cylinder is to be removed from the shaft, the same tool (Allen wrench, screwdriver or other suitable tool) is used to loosen the actuation member(s) of the bushings. Once the pressure applied by the pressurized fluid in the bushings is released, the integral unit including the cylinder, the bushings and the bearers can be removed and a new cylinder can be installed.

Thus, no hydraulic actuators and bores are required to remove the bearers from the cylinder shaft as in the prior art. In addition, a small cylinder is still light enough to lift easily because it is hollow and only includes relatively light-weight bushings and bearers, and a large cylinder can be ejected to a loading cart or other device.

In addition, the novel arrangement of the bushings and the bearers of the preferred embodiments of the present invention allows the pressure supplied from the bushing to be directed onto the clamping portion of the bearer which is spaced from the bearer surface or point of the bearer (the portion of the bearer on which the cylinder is mounted). As a result, this arrangement of the bushings and bearers eliminates the possibility of the bushing cracking or fatiguing caused by flexure or bowing in the cylinder and the shaft.

Instead of providing one or more actuators for each bushing in the preferred embodiment described above, a single actuator can be provided for adjusting the amount of pressure applied by each of the bushings. More specifically, the pockets in each of the bushings could be connected via a suitable pressurized fluid line to a single actuator such that when the single actuator is adjusted, the pressure applied by each of the bushings is adjusted. This eliminates the need for providing an actuator on each bushing. The single actuator for the two bushings can be preferably located within the cylinder, on the printing machine or some other suitable location.

It should be noted that the preferred embodiments of the present invention do not require the use of two bushings and two bearers, i.e. one bushing-bearer combination provided at each of the two opposite ends of the hollow cylinder. In certain printing machines having relatively short cylinders, a single bushing and bearer combination can be provided at only one end of the hollow cylinder. Because of the relatively short length of the cylinders, one clamping mechanism in the form of the single bushing and bearer combination is sufficient to clamp the cylinder to a cylinder shaft.

In a further modification of the preferred embodiments of the present invention, a single bushing extending inside of a hollow cylinder along substantially the entire length of the cylinder can be used to clamp the hollow cylinder to a cylinder shaft. The single bushing may include one or more sealed pockets containing pressurized fluid for applying pressure outwardly so that the bushing expands outwardly to clamp or reverse shrink-fit the hollow cylinder on the cylinder shaft via the bushing.

In another alternative preferred embodiment, instead of providing independent sealed pockets of pressurized fluid in the bushings, a remote source of pressurized fluid can be provided outside of the rotating components of the cylinder retention device. The remote source of pressurized fluid preferably comprises a stationary reservoir of hydraulic fluid that is preferably attached to a stationary part of the printing machine. The stationary remote pressurized fluid reservoir is connected via suitable fluid transport lines to pockets formed in the rotatable bushings included as part of the cylinder retention device as described above. The fluid transport lines are preferably located inside of the hollow cylinder of the cylinder retention device.

In another modified preferred embodiment, instead of using an independent supply of hydraulic fluid to apply pressure to the bearers via the bushings, a pressure source that is already existing in a printing machine can be used. For example, pressurized fluid cylinders used for throw-off of printing cylinders for cylinder form changeover, could be used to supply pressurized fluid to the bushings so that the bushings apply a desired amount of pressure to the bearers. The bushings in this preferred embodiment preferably have at least one pocket for receiving pressurized fluid from the already present pressurized fluid source of the printing machine. The pressurized fluid source in this preferred embodiment is similar to the remote hydraulic fluid reservoir. That is, the already present pressurized fluid source provided in the printing machine for performing another function (i.e., throw-off of printing cylinders) is connected via suitable fluid transport lines to the pockets formed in the bushings. The fluid transport lines in this preferred embodiment are also preferably located inside of the hollow cylinder of the cylinder retention device.

In still yet a further preferred embodiment, a control unit is provided for automatically adjusting the amount of pressurized fluid being compressed, to thereby adjust the amount of pressure applied on the bearers by the bushings. The control unit preferably includes a pressure sensor, a controller and a motor which are arranged such that when the control device receives a signal from the pressure sensor indicating that a desired pressure is not present at one or more of the bushings, the control device using a feedback control loop, for example, sends a signal to the motor connected to the pressure actuator(s) to adjustably move the actuator(s) to change the pressure to a desired amount.

Other features and advantages of the present invention will become apparent from the following description of the preferred embodiments of the invention which are shown in the accompanying drawings.

DETAILED DESCRIPTION OF PREFERRED EMBODIMENTS

Figure 3:
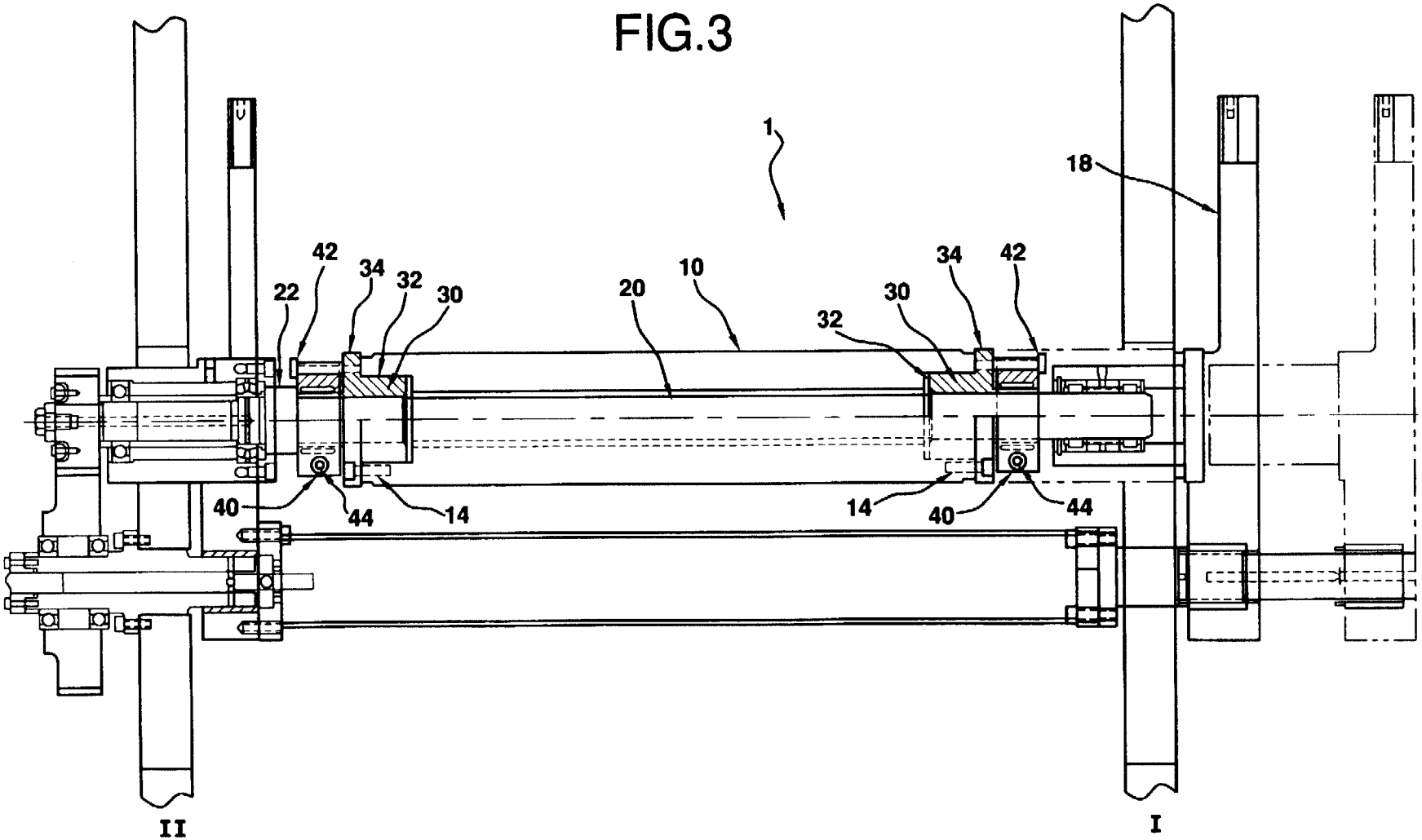
FIG. 3 is a sectional view of the hollow cylinder retention device of a preferred embodiment of the present invention.

Referring now to the drawings, wherein like reference numerals indicate like elements, a preferred embodiment of the present invention is shown in FIG. 3. The entire printing machine in which the structure shown in FIG. 3 is provided is not shown in FIG. 3 for the purposes of clarity of description of the preferred embodiments of the present invention. However, the printing machine in which the structure shown in FIG. 3 is provided is similar to the printing machine described in U.S. Pat. No. 5,351,616, the disclosure of which has been incorporated herein by reference.

As seen in FIG. 3, the cylinder retention device 1 according to a preferred embodiment of the present invention includes a hollow cylinder 10 mounted on a shaft 20. The cylinder retention device 1 also includes bearers 30 located at opposite ends of the cylinder 10. The cylinder retention device 1 further includes bushings 40 located at opposite ends of the cylinder 10 and arranged so as to surround a portion of a respective bearer 30. The structure of the bushing 40 is the subject of U.S. Pat. No. 4,093,052.

Each of the bushings 40 is connected to a respective bearer 30 via retaining members 42, such as a screw or other suitable connector. The bushings 40 also preferably include at least one actuator member 44, such as an actuation screw or other suitable actuation member. In an alternative preferred embodiment to be described later, a single actuator member may be provided to actuate both bushings 40.

Figure 4:
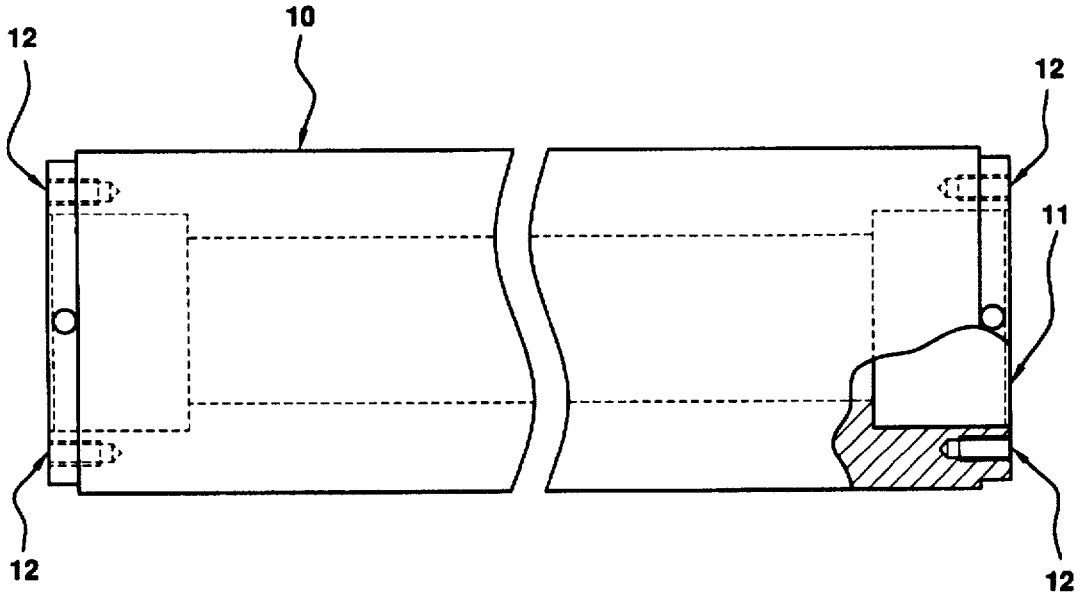
FIG. 4 is a partly sectional view of the hollow cylinder of the hollow cylinder retention device of FIG. 3.

The bearers 30 are preferably connected to bores 12 shown in FIG. 4. The bores 12 are formed in shoulder portions 11 of the cylinder 10 to receive cap screws 14 or other suitable connecting devices for connecting the bearers 30 to the cylinder 10.

Thus, the hollow cylinder 10, the bearers 30 and the bushings 40 are preferably connected to each other to form a unitary integral cylinder unit which is mounted on the shaft 20 as described below.

Figure 5:
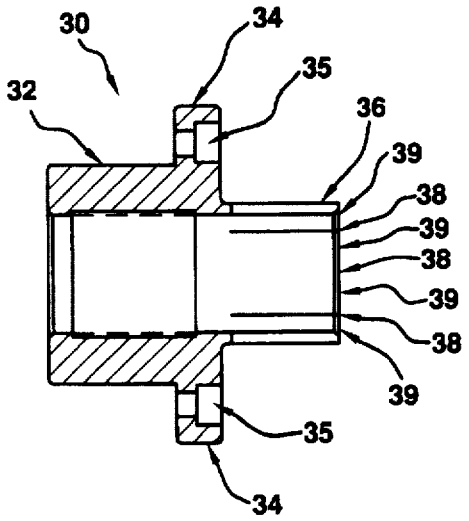
FIG. 5 is a sectional view of a bearer provided in the hollow cylinder retention device of FIG. 3.

As seen in FIGS. 3 and 5, each of the bearers 30 includes a cylinder mounting portion 32 and a cylinder bearer portion 34 adjacent the cylinder mounting portion 32. As seen in FIG. 3, the cylinder 10 is mounted on the cylinder mounting portion 32 and an end of the cylinder 10 abuts against the cylinder bearer portion 34 so as to locate the cylinder 10 horizontally along the bearer 30. Although it is not necessary, the cylinder 10 may be aligned with the bearer 30 so that the outer surface of the cylinder 10 is flush with an outer surface of the cylinder bearer portion 34. The cylinder bearer portion 34 preferably includes a plurality of bores 35 for receiving the cap screws 14 to connect the bearers 30 to the cylinder 10.

The bearers 30 further include a pressure receiving portion 36 extending from the cylinder bearer portion 34. As is seen in FIG. 5, the cylinder mounting portion 32 has a first diameter, the cylinder bearer portion 34 has a second diameter larger than the first diameter and the pressure receiving portion 36 has a third diameter that is less than the first and second diameters.

The pressure receiving portion 36 preferably has a plurality of slits or recesses 38 formed therein which results in the formation of a plurality of tangs or fingers 39. The function of the fingers 39 will be described below.

Figure 6:
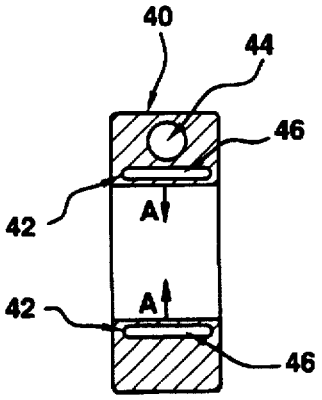
FIG. 6 is a sectional view of a bushing provided in the hollow cylinder retention device of FIG. 3.

Each of the bushings 40, more clearly shown in FIG. 6, comprises a hollow member having a diameter that is sufficient to fit over the third diameter of the pressure receiving portion 36 of the bearers 30. The bushings 40 also include one or more closed pockets 46 preferably containing pressurized fluid, for example, hydraulic fluid. At least one actuator 44 is provided in each bushing 40 and the actuator 44 is preferably in the form of an actuation screw or other suitable actuating member. When the actuator 44 is rotated in a first direction or actuating direction, the hydraulic fluid is compressed inwardly in the direction of arrow A toward the pressure receiving portion 36 and the shaft 20. When the actuator 44 is rotated in a second direction opposite to the actuating direction, the hydraulic fluid 46 is no longer compressed and the pressure on the pressure receiving portion 36 and the device 1 including the cylinder 10 is released from the shaft 20.

Figure 1:
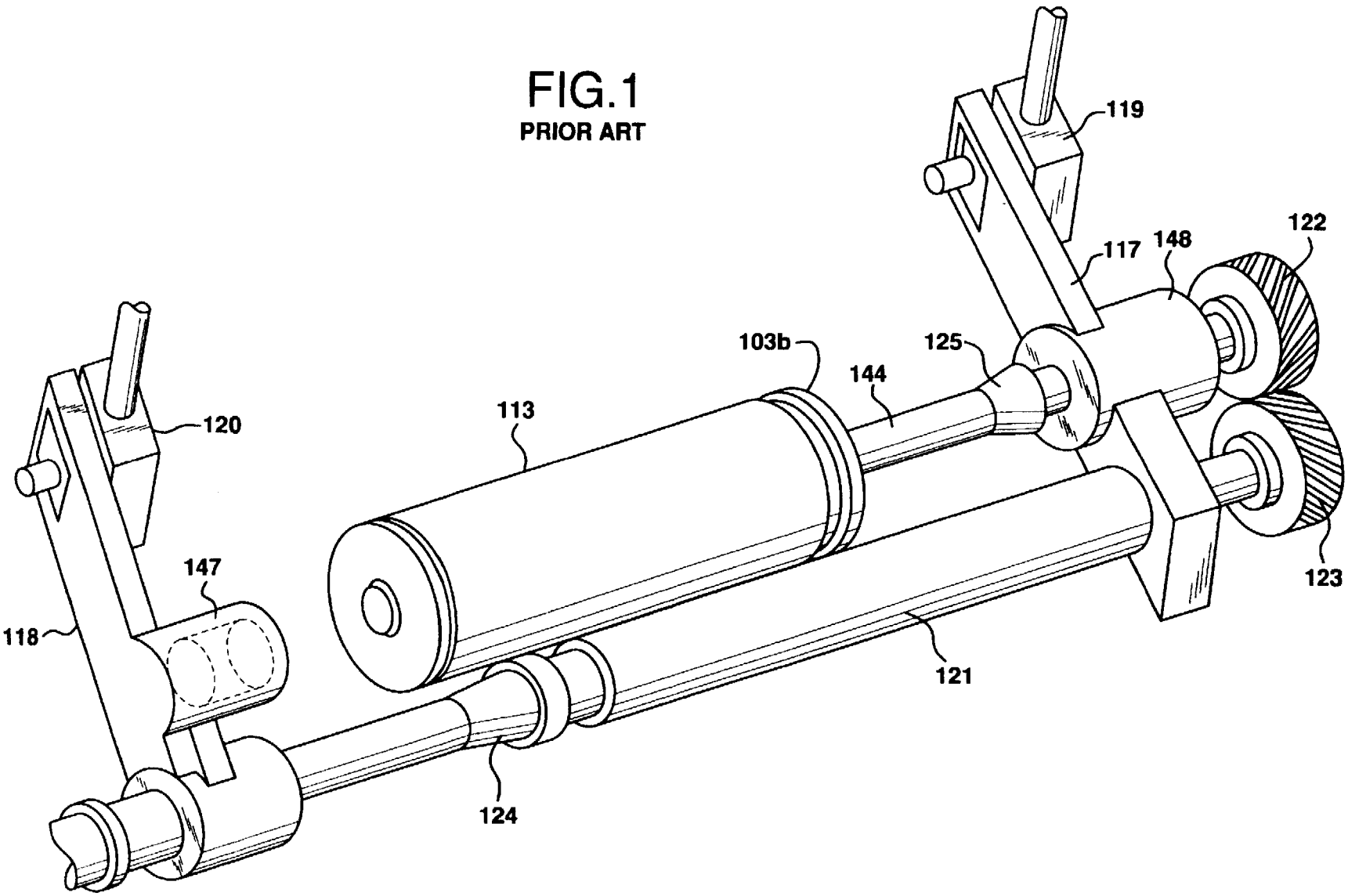
FIG.1 PRIOR ART
FIG. 1 is a partly exploded view of a conventional cylinder retention device.
Figure 2:
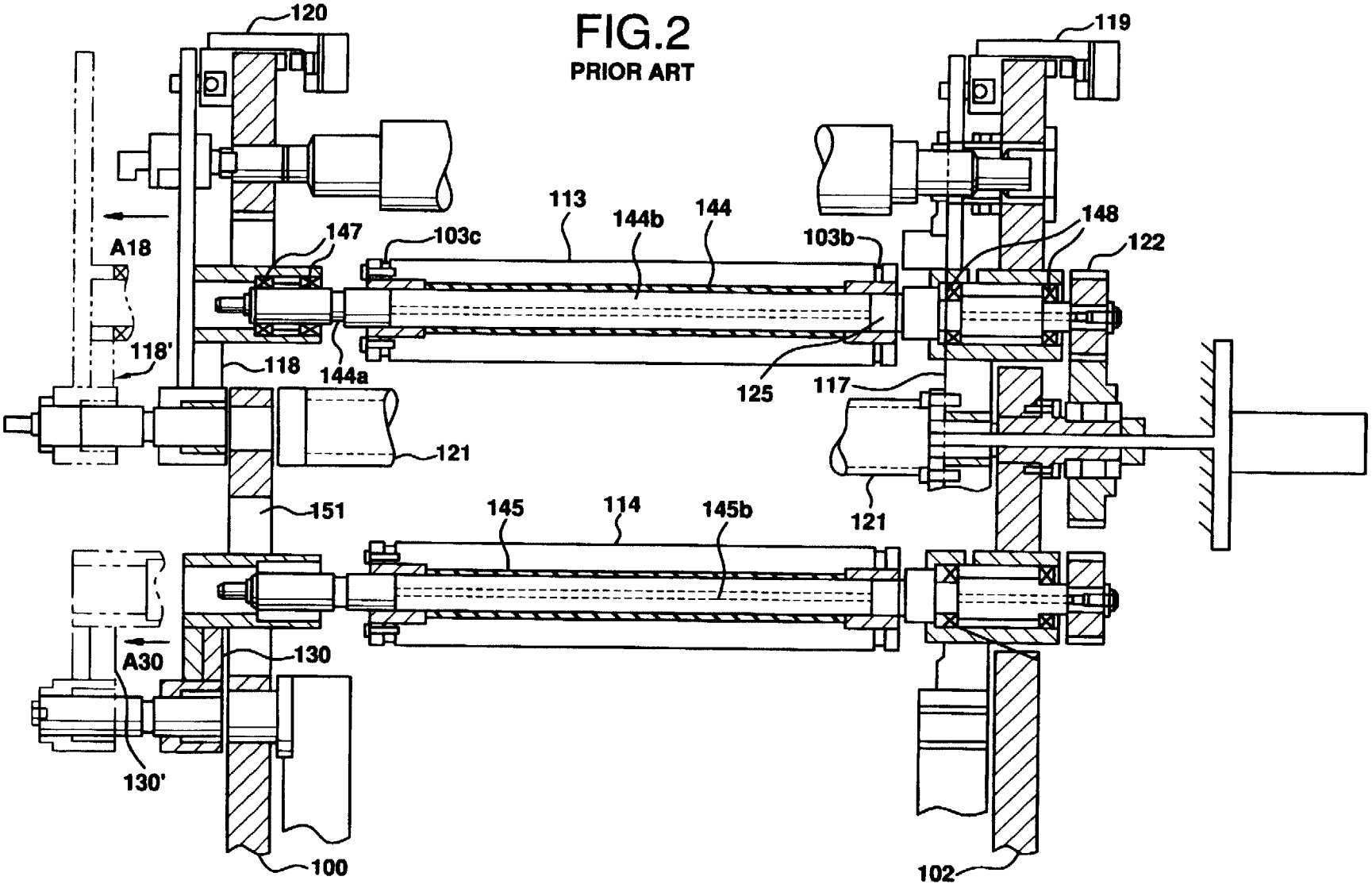
FIG.2 PRIOR ART
FIG. 2 is a fragmentary vertical sectional view of the conventional cylinder retention device shown in FIG. 1.

An operation of the cylinder retention device 1 described above is as follows. When a cylinder 10 is to be replaced, the cylinder supporting arm 18 (similar to arm 18 shown in FIG. 2) on the working side of the printing machine (the right side in FIG. 3) is moved to the dotted line position shown in FIG. 3. Using an Allen wrench or other suitable tool, the actuators 44 of both bushings 40 are rotated in the second direction to release the pressure of the hydraulic fluid 46 on the clamping portion 36 and the shaft 20. As a result of the release in pressure, the clamping portion 36 of each bearer 30 no longer clamps the cylinder 10 to the shaft 20. Consequently, the entire assembly 1 including the cylinder 10, the bearers 30 and the bushings 40 can be axially slid off of the shaft 20.

A replacement cylinder unit including the hollow cylinder 10, bearers 30 and bushings 40 is then axially slid onto the shaft 20 until an end portion of the bushing 40 contacts a shoulder portion 22 of the shaft 20. Then the actuators 44 are rotated in the first direction to compress the hydraulic fluid thereby applying pressure to the clamping portion 36 of the bearers 30. The fingers 39 are compressed inwardly in the direction A to securely clamp the cylinder 10 to the shaft 20.

It should be noted that the above described cylinder 10 may comprise a plate cylinder, a blanket cylinder or any other cylinder for use in a printing machine. In addition, although the use of hydraulic fluid is preferred, any other pressurized fluid or pressure applying mechanism may also be used to supply pressure to the clamping portion 36 of the bearers.

Although the preferred embodiments of the invention have been described as including fingers 39 in the clamping portions 36 of the bearers 30, the clamping portions 36 of the bearers 30 can be formed to be solid with no recesses or slits defining fingers therein.

Although the connection between the cylinder and bearers 30 has been described in terms of cap screws, any other suitable connecting mechanism can be used.

Figure 7:
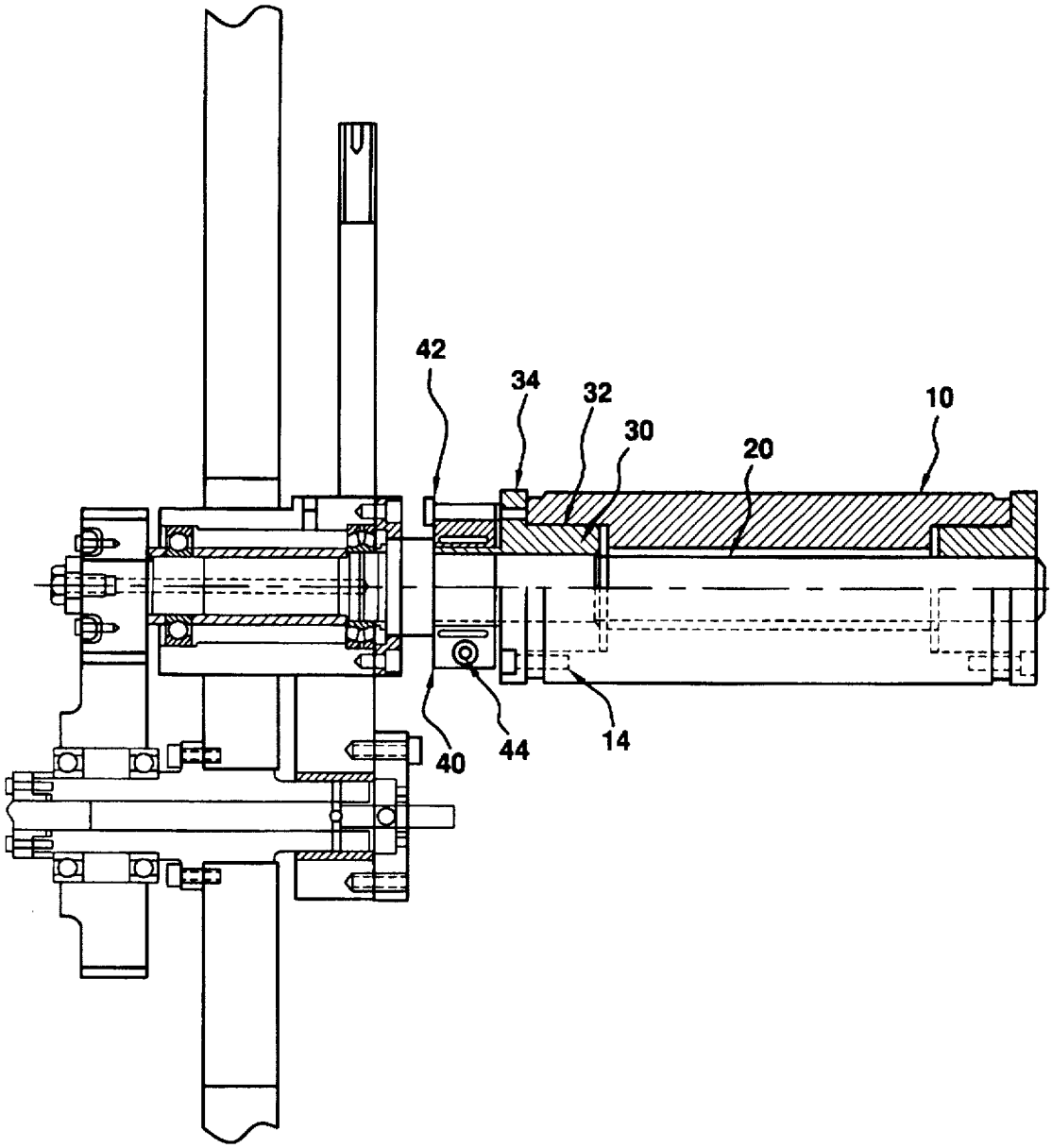
FIG. 7 is a sectional view of an alternative embodiment of the hollow cylinder retention device in a print machine having relatively short length printing cylinders.

In a first alternative embodiment shown in FIG. 7, a single bushing-bearer combination is provided at one end of a hollow cylinder 10. The printing machine shown in FIG. 7 includes a relatively short length printing cylinder 10. As a result, only one bushing 40 is required to clamp the cylinder 10 to the shaft 20. The single bushing 40 is arranged in a manner similar to the preferred embodiment described above and shown in FIG. 3.

Thus, not all of the preferred embodiments of the invention require the use of two bushings, i.e. one bushing-bearer combination provided at the two opposite ends of the hollow cylinder. In certain printing machines having relatively short length cylinders, a single bushing and bearer combination provided at only one end of the hollow cylinder can be provided. Because of the relatively short length of the cylinders, one clamping mechanism in the form of the single bushing and bearer combination is sufficient to clamp the cylinder to the cylinder shaft.

Figure 8:
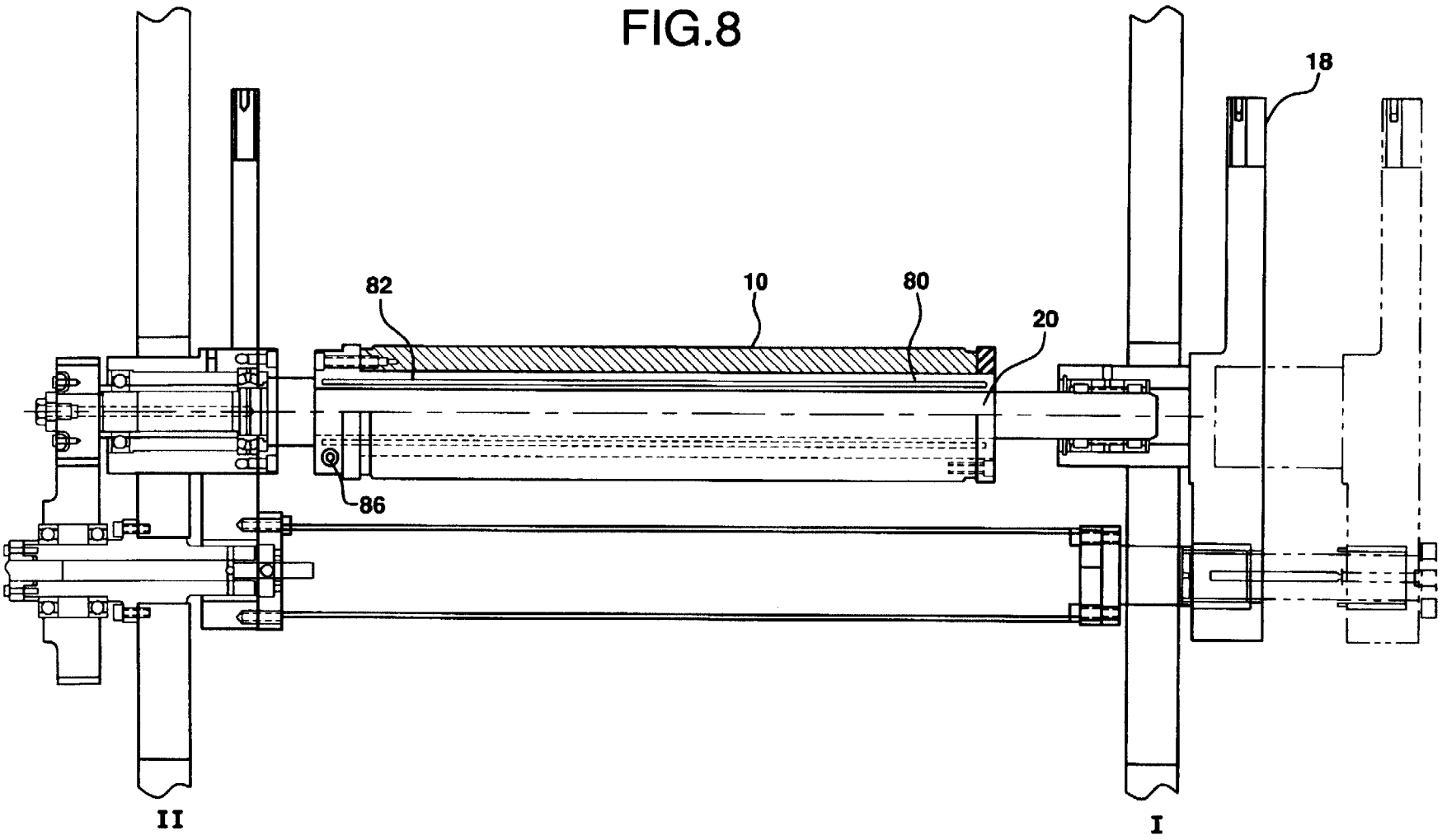
FIG. 8 is a sectional view of an alternative embodiment of the hollow cylinder retention device shown in FIG. 3 including a single bushing disposed inside of a hollow cylinder.

In a further modification of the preferred embodiments of the present invention shown in FIG. 8, a single bushing 80 extending inside of a hollow cylinder 10 along substantially the entire length of the cylinder 10 can be used to clamp the cylinder to a cylinder shaft 20. The structure of the bushing 80 is different from the bushing 40 shown in FIG. 3.

In order to clamp the bushing 80 to the shaft 20 and to clamp the hollow cylinder 10 to the shaft 20, the bushing 80 includes at least one pocket 82 of pressurized fluid which is arranged to expand both outwardly in the direction of the hollow cylinder 10 (away from the shaft 20) and inwardly in the direction of the shaft 20. The bushing 80 preferably comprises a hollow cylindrical body including at least one pocket 82 containing the pressurized fluid. The fluid in the pocket 82 is compressed by use of a suitable actuator member 86, similar to actuator member 44 shown in FIG. 3.

The bushing 80 may be either independent from the hollow cylinder 10 or attached to the hollow cylinder 10 via suitable means such as adhesive. When a cylinder 10 is to be replaced, the actuator 86 is rotated in a direction opposite to the actuating direction thereby releasing the pressure on the cylinder 10. The cylinder 10 and bushing 80 can be removed from the shaft 20, either together or independent from each other depending on whether the hollow cylinder 10 and bushing 80 are attached to each other. Then a new bushing 80 and hollow cylinder 10 can be slid over the shaft 20 and the actuator 86 of the new bushing 80 can be rotated in the actuating direction to clamp the bushing 80 to the shaft 20 and to reverse shrink-fit the hollow cylinder 10 to the bushing 80 and shaft 20.

Figure 9:
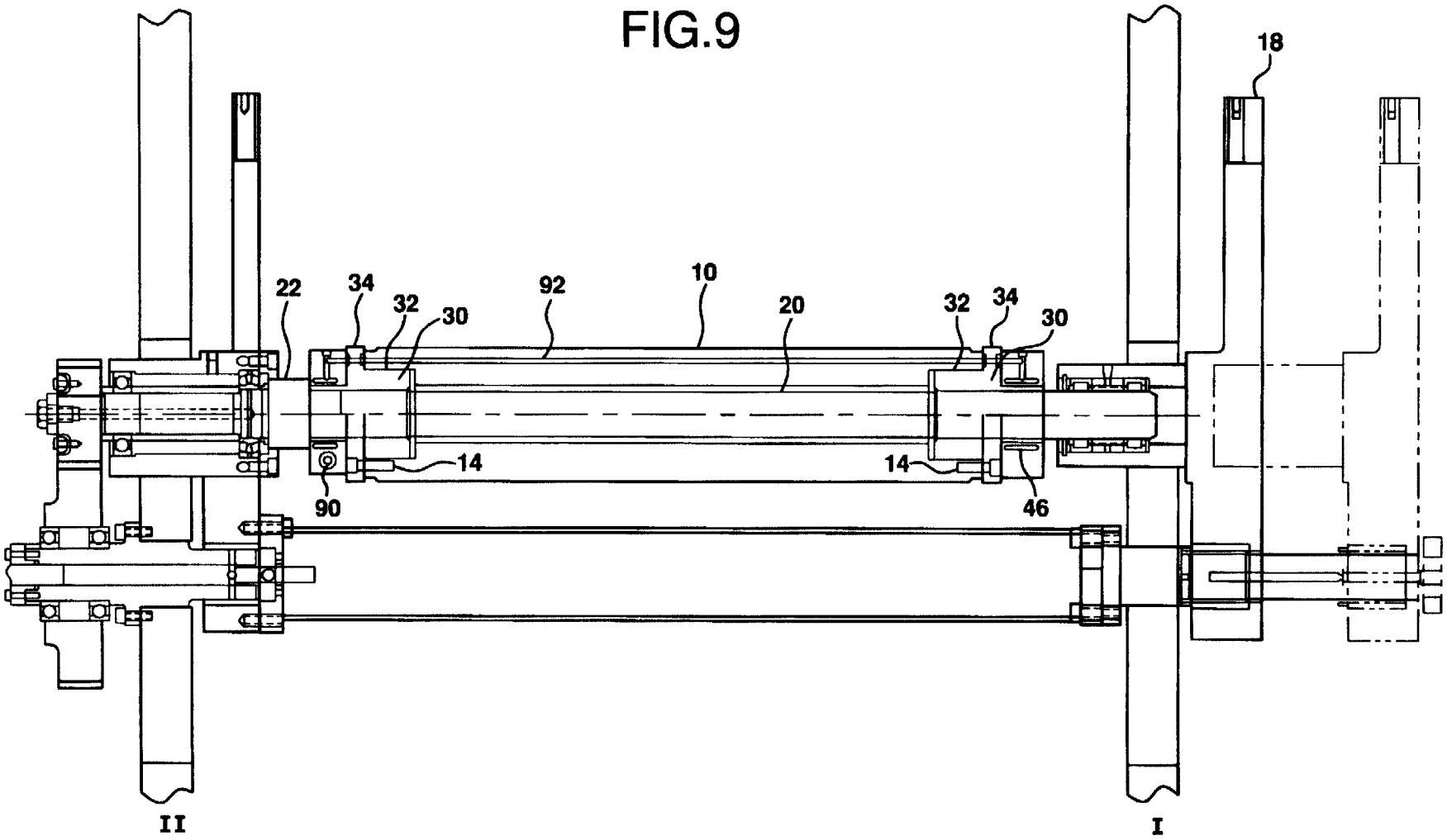
FIG. 9 is a sectional view of an alternative embodiment of the cylinder retention device shown in FIG. 3 including a single actuating device for actuating the two bushings.

In yet another preferred embodiment shown in FIG. 9, a single actuator 90 is provided for actuating each of the bushings 40. Instead of sealing the pockets 46 as in the embodiment shown in FIG. 3, the pockets 46 in each of the bushings 40 of the embodiment shown in FIG. 9 are preferably connected to a single actuator 90 via suitable pressurized fluid transporting lines 92. As a result, when the single actuator 90 is rotated in the actuating direction, the pressure applied by each of the bushings 40 on the bearers 30 is adjusted. This eliminates the need for providing an actuator on each bushing as shown in FIG. 3. The single actuator 90 for actuating the bushings 40 can be preferably located within the cylinder, on the printing machine or some other suitable location.

In the embodiment shown in FIG. 9, fluid transport lines 92 are connected to the pockets 46 formed in the rotatable bushings 40. The fluid transport lines 92 are preferably located inside of the hollow cylinder 10 of the cylinder retention device.

In a modification of the preferred embodiment shown in FIG. 9, pressurized fluid cylinders used for throw-off of printing cylinders for cylinder form changeover, could be connected to the bushings 40 via pressurized fluid transport lines 92 and thereby, be used to supply pressurized fluid to the bushings 40 so that the bushings apply a desired amount of pressure to the bearers 30. The bushings 40 in this embodiment preferably have at least one pocket 46 for receiving pressurized fluid from the pressurized fluid cylinders.

In still yet a further embodiment not shown, a control unit is provided for automatically adjusting the amount of pressurized fluid being compressed, to thereby adjust the amount of pressure applied on the bearers 30 by the bushings 40. The control unit preferably includes a pressure sensor (i.e. pressure transducer) and related control device (i.e. a microprocessor, computer, etc.) and motor. A pressure sensor is provided at each of the locations where the bushings 40 apply pressure to the bearers 30. The pressure sensor(s) is connected to the control device, preferably in the form of a microprocessor or other suitable controller, and to the motor. The motor is connected to the actuator 44 to automatically adjust the actuator position either in the actuating direction or in the releasing direction.

The operation of the control unit is as follows. The pressure sensor continuously supplies pressure values to the control device. When one of pressure values from the pressure sensors is not within a desired range or equal to a desired value, the control device detects this condition and sends a signal to the motor. Based on the signal received from the control device, the motor then rotates the actuator 44 in a suitable direction until the desired pressure range or value is applied by the bushing 40 to the bearer 30.

Although the present invention has been described in relation to particular preferred embodiments thereof, many other variations and modifications and other uses will become apparent to those skilled in the art. It is preferred, therefore, that the present invention be limited not by the specific disclosure herein, but only by the appended claims.

What is claimed is:

1. A cylinder retention device for mounting a cylinder on a shaft, the cylinder retention device comprising:

a cylinder;

at least two bearers each connected to the cylinder at opposite ends of the cylinder for supporting the cylinder at bearer points on the at least two bearers;

at least two bushings each mounted on one of the at least two bearers;

at least one actuator connected to the at least two bushings for adjusting pressure applied by each of the at least two bushings to a respective one of the at least two bearers to clamp the cylinder onto the shaft; wherein the at least two bushings are arranged to apply pressure on a respective one of the at least two bearers at a location that is spaced from the bearer points.

2. The cylinder retention device of claim 1, wherein the cylinder is hollow.

3. The cylinder retention device of claim 1, wherein each of the bearers include a cylinder mounting portion having a first diameter for mounting the cylinder thereon, a cylinder bearer portion adjacent the cylinder mounting portion and having a second diameter larger than the first diameter for locating the cylinder along the cylinder mounting portion and a clamping portion adjacent the cylinder bearer portion and having a third diameter less than the first and second diameters for receiving pressure from a respective one of the at least two bushings to clamp the cylinder to the shaft.

4. The cylinder retention device of claim 3, wherein each of the at least two bushings are mounted on the clamping portion of a respective one of the bearers.

5. The cylinder retention device of claim 1, wherein each of the at least two bushings include at least one pocket containing pressurized fluid arranged to be compressed by the at least one actuator to apply a clamping force a respective one of the at least two bearers.

6. The cylinder retention device of claim 1, wherein at least one of the at least two bearers includes a clamping portion having a plurality of recesses formed therein defining a plurality of fingers extending in a direction of a longitudinal axis of the cylinder.

7. The cylinder retention device of claim 1, wherein the cylinder has a plurality of bores formed therein for receiving a plurality of connectors connecting the cylinder to the at least two bearers.

8. The cylinder retention device of claim 7, wherein each of the at least two bearers includes at least one bore aligned with one of the bores formed in the cylinder and adapted to receive one of the connectors.

9. The cylinder retention device of claim 1, wherein the cylinder, the at least two bearers and the at least two bushings are integrally connected to form a single unit that is adapted to be axially slid along the shaft for mounting the single unit on the shaft and for removing the single unit from the shaft.

10. The cylinder retention device of claim 1, wherein each of the at least two bushings include at least one pocket containing pressurized fluid arranged to be compressed by the at least one actuator to apply a clamping force to a respective one of the at least two bearers and a reservoir of pressurized fluid is connected to the pockets in each of the at least two bushings for supplying the pressurized fluid thereto.

11. The cylinder retention device of claim 1, wherein the at least one actuation member is a first actuation member and is connected to one of the at least two bushings and the other of the at least two bushings has a second actuation member connected thereto, the first and second actuation members being arranged on a respective one of the at least two bushings for adjusting pressure applied by the respective one of the at least two bushings to a respective one of the at least two bearers to clamp the cylinder onto the shaft.

12. The cylinder retention device of claim 1, wherein at least one of the at least two bearers includes a clamping portion having a plurality of recesses formed therein defining a plurality of fingers extending in a direction of a longitudinal axis of the cylinder.

13. A cylinder unit for being mounted on a shaft, the cylinder unit comprising:

a cylinder;

at least one bearer connected to the cylinder at an end portion of the cylinder;

at least one bushing mounted on the at least one bearer and including an actuator for applying pressure to the at least one bearer for supporting the cylinder at a bearer point on the at least one bearer to clamp the cylinder onto the shaft; wherein the at least one bushing is arranged to apply pressure on the at least one bearer at a location that is spaced from the bearer point.

14. The cylinder unit of claim 13, wherein the at least one bearer includes a clamping portion having a plurality of recesses formed therein defining a plurality of fingers extending in a direction of a longitudinal axis of the cylinder.

15. The cylinder unit of claim 13, wherein the cylinder includes a hollow sleeve and comprises one of a printing plate cylinder and a blanket cylinder.

16. The cylinder unit of claim 13, further comprising connectors and wherein the cylinder comprises a hollow sleeve and shoulder portions having a plurality of bores formed therein for receiving the connectors for connecting the hollow sleeve to the at least one bearer.

17. The cylinder unit of claim 13, the at least one bearer includes at least one bore aligned with one of the bores formed in the cylinder and adapted to receive one of the connectors.

18. The cylinder unit of claim 13, wherein the at least one bearer includes a cylinder mounting portion having a first diameter for mounting the cylinder thereon, a cylinder bearer portion adjacent the cylinder mounting portion and having a second diameter larger than the first diameter for locating the cylinder along the cylinder mounting portion and a clamping portion adjacent the cylinder bearer portion and having a third diameter less than the first and second diameters for receiving pressure from the at least one bushing to clamp the cylinder to the shaft.

19. The cylinder unit of claim 13, wherein the cylinder, the at least one bearer and the at least one bushing are integrally connected to form a single unit that is adapted to be axially slid along the shaft for mounting the single unit on the shaft and for removing the single unit from the shaft.

20. A cylinder unit for being mounted on a shaft, the cylinder unit comprising;

a cylinder;

at least one bearer connected to the cylinder at an end portion of the cylinder;

at least one bushing mounted on the at least one bearer and including at least one actuator for applying pressure to the at least one bearer to clamp the cylinder onto the shaft; wherein the at least one bearer includes first, second and third portions each having diameters that are different from each other, the at least one bushing being mounted on the one of the first, second and third portions having a minimum diameter.

21. The cylinder unit of claim 20, wherein the one of the first, second and third portions having the minimum diameter has a plurality of slits formed therein defining a plurality of fingers extending along a longitudinal axis of the cylinder.

22. The cylinder unit of claim 20, wherein the at least one bushing has at least one pocket formed therein containing hydraulic fluid for applying a clamping force to the one of the first, second and third portions having the minimum diameter to clamp the cylinder to the shaft.

23. The cylinder unit of claim 20, wherein the at least one bearer, the at least one bushing and the cylinder are integrally connected to form a single unit that is adapted to be axially slid along the shaft for mounting the single unit on the shaft and for removing the single unit from the shaft.

24. The cylinder of claim 20, wherein the cylinder includes a hollow sleeve and comprises one of a printing plate cylinder and a blanket cylinder.

* * * * *